US006209647B1

(12) United States Patent
Brown, Jr.

(10) Patent No.: US 6,209,647 B1
(45) **Date of Patent: *Apr. 3, 2001**

(54) DOWN HOLE CASING STRING CLEANING DEVICE AND METHOD

(76) Inventor: Billy L. Brown, Jr., 888 W. Houston Pkwy. South Ste. 270, Houston, TX (US) 77042

( * ) Notice: Subject to any disclaimer, the term of this patent is extended or adjusted under 35 U.S.C. 154(b) by 0 days.

This patent is subject to a terminal disclaimer.

(21) Appl. No.: 09/361,066

(22) Filed: Jul. 26, 1999

Related U.S. Application Data

(63) Continuation-in-part of application No. 09/133,913, filed on Aug. 13, 1998, now Pat. No. 5,947,203, which is a continuation of application No. 08/804,216, filed on Feb. 21, 1997, now Pat. No. 5,829,521.

(51) Int. Cl.[7] ..... E21B 37/00
(52) U.S. Cl. ..... 166/311; 166/173; 15/104.2
(58) Field of Search ..... 166/170, 172–174, 166/176, 311; 15/104.05, 104.095, 104.16, 104.2

(56) References Cited

U.S. PATENT DOCUMENTS 2,682,069 * 6/1954 Scriminger ..... 15/104.2 X
3,032,114 * 5/1962 Best ..... 106/173
3,824,646 * 7/1974 Jai ..... 15/104.2
3,827,492 * 8/1974 Hammon et al. ..... 166/173
4,438,812 * 3/1984 Hammon ..... 166/173
4,501,322 * 2/1985 Martin ..... 166/173
4,503,578 * 3/1985 McIntyre ..... 15/104.2 X
5,419,397 * 5/1995 Reynolds ..... 166/312
5,570,742 * 11/1996 Reynolds et al. .
5,711,046 * 1/1998 Potter ..... 166/173 X
5,819,353 * 10/1998 Armell et al. ..... 15/104.2
5,829,521 * 11/1998 Brown ..... 166/173
5,947,203 * 9/1999 Brown ..... 166/311

* cited by examiner

*Primary Examiner*—Roger Schoeppel
(74) *Attorney, Agent, or Firm*—Dominigue & Waddell, PLC

(57) ABSTRACT

A down hole cleaning assembly and method of cleaning a tubular. Generally, the down hole assembly is connected to a work string concentrically located within a casing string. In one embodiment, the down hole assembly comprises a mandrel operatively connected to the work string, with the mandrel having an opening therein. A pad member is received within the opening, with the pad member having a groove formed therein. Also provided is a wire brush member, operatively positioned within the groove of the pad member, for cleaning the internal diameter of the casing string. The pad member and groove may be helical, with the wire brush member positioned within the groove. The down hole assembly further comprises a biasing member, operatively positioned between the mandrel and the pad member, adapted for biasing the wire brush means against the inner diameter of the well bore.

20 Claims, 12 Drawing Sheets

DOWN HOLE CASING STRING CLEANING DEVICE AND METHOD

This application is a continuation-in-part application of my application Ser. No. 09/133,913 filed on Aug. 13, 1998 now U.S. Pat. No. 5,947,203, which is a con't of 08/804,216 filed Feb. 21, 1997 U.S. Pat. No. 5,829,521. This invention relates to a down hole assembly used to clean tubular strings. More particularly, but not by way of limitation, this invention relates to an apparatus and method for cleaning the internal diameter of casing strings with a bristle brush circumferentially arranged about a down hole assembly.

BACKGROUND OF THE INVENTION

In the development of oil and gas fields, operators will drill a well to a hydrocarbon reservoir, and thereafter, run a casing string through the production formation. The casing string will then be cemented into place. In turn, the well will then be completed as is well appreciated by those of ordinary skill in the art.

The optimization of production is an important criteria of any completion. Studies have shown that residue on the internal diameter of the casing string (such as cement, pipe dope, scale, burrs, etcetera) have a negative impact on productivity. Specialized completion fluids devoid of fines, solids and other debris are used to complete the well. Therefore, a major emphasis has been made to clean the inner diameter of the casing string.

Thus, when the operators have finished the pumping of a cement composition through the well casing, a work string is lowered on which a mechanical scraping device is used to scrap the walls of the casing. In the prior art, various types of casing scrapers are in use prior to displacement of a clean completion fluid. That is why it is so important to clean the casing wall as much as possible since it takes less time to ultimately filter the displaced completion fluids. Also, cleaning will eliminate foreign matter such as cement sheaths, scale, burrs and barite which in turn allows the tools used in the completion process to properly perform.

The scraping action of traditional scrapers with blades also have been known to leave a fine film of oil base or synthetic fluid residue on the casing wall. Prior art devices also cause problems because of the hardness of their blades cannot get into the casing connections as brushes can. Also, casing scrapers in high deviated holes collapse to the low side of the casing causing a great deal of wear on one side and the top side of the hole is not properly cleaning the high side due to ineffective engagement with the high side.

Therefore, there is a need for a down hole assembly that will be effective in cleaning a well bore that contains an oil base and/or synthetic fluid. There is also a need for a cleaning apparatus that will be effective in highly deviated wells. There is also a need for a down hole assembly that will have brush pads that are of sturdy construction and allow for ease of replacement.

SUMMARY OF THE INVENTION

A down hole cleaning assembly is disclosed. Generally, the down hole assembly is connected to a work string concentrically located within a casing string. In one embodiment, the down hole assembly comprises a mandrel operatively connected to the work string, with the mandrel having an opening therein. A pad member is received within the opening, with the pad member having a groove formed therein. Also provided is a wire brush means, operatively positioned within the groove of the pad member, for cleaning the internal diameter of the casing string.

The down hole assembly further comprises a biasing member, operatively positioned between the mandrel and the pad member, adopted for biasing the wire brush means against the inner diameter of the well bore. In the preferred embodiment, the wire brush means comprises a wire bundle having a first end and a second end, a brace disposed about the second end of the wire bundle, and wherein the brace is disposed within the groove of the pad member.

The brace herein disclosed includes an open end and a closed end, with the closed end having disposed therein the second end of the wire bundle, and wherein the open end and the closed end cooperate to form a triangular shaped profile. The groove will also contain a triangular shaped profile adapted to slidably receive the triangular brace.

In the preferred embodiment, the mandrel contains a second of slot, and wherein the down hole assembly further comprises a second pad member adapted to be received within the second slot, the second pad containing a second groove formed therein. A second wire brush means, operatively positioned within the second groove of the pad member, is also provided for cleaning the internal diameter of the casing string.

The down hole assembly may also contain a centralizer means, operatively adopted to the work string, for centralizing the mandrel within the casing string. A dove tail means, operatively associated with the mandrel, is also included for selectively adapting the wire brush means onto the work string.

In the preferred embodiment, the first and second wire brush means are arcuate, and wherein said first wire brush means is disposed about the periphery of the mandrel to cover a first 180 degree phase and wherein the second wire brush means is disposed about the periphery of the mandrel to cover a second 180 degree phase so that the first wire brush means and the second wire brush means cover a 360 degree phase about the mandrel. In another embodiment, a plurality of wire brush means may be placed about the periphery of the mandrel, with the wire brush means being staggered circumferentially in relation to each other so that the wire brushes have an effective coverage area of 360 degrees.

Also disclosed herein is a method of cleaning a casing string. The method comprises lowering a work string within the casing string. The work string will have provided therewith a down hole cleaning apparatus operatively associated with the work string. The wire bundle of the cleaning apparatus will be urged against the inner diameter of the casing string via the spring to allow for constant pressure of the brushes against the casing wall at all times. The method provides for cleaning the inner diameter of the casing string as the work string is lowered.

The method further comprising rotating the work string, and thereafter, lowering the work string. The operator may then circulate a drilling fluid through the inner diameter of the work string. The work string may be stationary or rotating during circulation.

In one embodiment, the well casing has a horizontal section so that a low side of the well casing and a high side of the well casing is created. In this embodiment, the apparatus includes a centralizer operatively associated with the work string. Also included will be a second cleaning apparatus, with the first cleaning apparatus covering a 180 degree phase and the second cleaning apparatus covering a complimentary 180 degree phase so that the entire 360 degree periphery is covered.

The method would further comprise lifting the apparatus from the low side of the inner diameter of the well casing with the centralizer. Also, the wire bundle of the first cleaning apparatus is urged against the low side of the inner diameter of the well casing with the spring at a constant force. Simultaneously therewith, the wire bundle of the second cleaning apparatus is urged against the high side of the inner diameter of the well casing with its spring at a constant force so that both the low side of the casing and the high side of the casing will be cleaned.

In a second embodiment, which in this application is the preferred embodiment, an apparatus for cleaning an inner diameter of a casing string is disclosed. In this embodiment, the down hole assembly comprises a mandrel having a first end and a second end, with the first end of said mandrel being configured to be connected to an opened end of a first tubular member and the second end of the mandrel being configured to be connected to an opened end of a second tubular member. The mandrel contains a first helical opening.

The apparatus further contains a first helical pad configured to be positioned within the first helical opening, with the helical pad having a groove therein. A wire brush member is inserted within the groove and a first spring is inserted between the first helical pad and the mandrel, with the spring biasing the helical pad radially outward.

The apparatus further contains a dove tail means, operatively associated with the mandrel, for selectively adapting the first second helical pad member with the mandrel. The dove tail means comprises the first tubular member having an opened end with an annular ring formed thereon that engages a first lip extending from the first helical pad, with the first lip being configured to adapt to the annular ring so that the first helical pad is held in place by the annular ring.

The apparatus further comprises a second helical opening formed on the mandrel and a second helical pad configured to be positioned within the second helical opening. The second helical pad will have a series of annular ribs disposed thereon. A second spring is inserted between the second helical pad and the mandrel, with the second spring biasing the second helical radially outward. In this embodiment, the dove tail means further comprises the second tubular member having an opened end with an annular ring formed thereon that engages the first lip so that the second helical pad is held in place by the annular ring.

The apparatus may further comprise a third helical opening formed on the mandrel, with the third helical pad being configured to be positioned within the third helical opening. The third helical pad contains a series of annular ribs. A third spring is inserted between the first helical pad and the mandrel, with the spring biasing the helical pad radially outward. A fourth helical opening may also be included, with a fourth helical pad configured to be positioned therein. The fourth helical pad will have a series of annular ribs. A fourth spring is inserted between the second helical pad and the mandrel for biasing the fourth helical pad radially outward.

In the preferred embodiment, the wire brush member comprises a wire bundle having a first end and a second end, a brace disposed about the second end of the wire bundle, and the brace is disposed within the groove of the pad member. The brace comprises an open end and a closed end, with the closed end having disposed therein the second end of the wire bundle, and wherein the open end and the closed end cooperate to form a triangular shaped profile. The groove will also have an angular shaped profile adapted to slidably receive the wedge of the brace. The first and second wire brush members will be arcuate. In one embodiment, the first wire brush member is disposed about the periphery of the mandrel to cover a first phase and wherein the second wire brush member is disposed about the periphery of the mandrel to cover a second phase.

A method of cleaning a casing string with this second embodiment is also disclosed. The method comprises lowering a work string within the inner diameter of the casing string and providing a cleaning apparatus operatively associated with the work string. The method includes urging the wire brush member against the inner diameter of the casing string with a first and second spring biasing a helical pad member and cleaning the inner diameter of the casing string. The method further comprises rotating and lowering the work string. A fluid may be circulated through the inner diameter of the work string which in turn will cause the fluid to be returned on the annulus side, with the fluid being channeled between and through the helical pad.

In one embodiment, the well casing has a highly deviated section so that a low side of the well casing and a high side is created, and the apparatus further comprises a centralizer operatively associated with said work string, with the first helical pad covering a first phase and the second helical pad covering a second phase. The method further comprises lifting the apparatus from the low side of the inner diameter of the well casing with the centralizer, urging the wire brush member of the first helical pad against the low side of the inner diameter of the well casing with said spring at a constant force and urging the wire brush member of the second helical pad against the high side of the inner diameter of the well casing with the spring at the constant force.

An advantage of the present invention includes the ability to thoroughly clean the internal diameter of the casing of a course material such as cement while at the same time being able to scour the casing of thin films left by oil base and synthetic muds that contain hydrocarbons. Another advantage includes that the design allows easy replacement of the components so that if a brush becomes worn, a new brush may be easily inserted therein at the rig location.

Another advantage includes use of wire bristles that are of sufficient hardness to allow for the scraping of the inner diameter of the casing. Yet another advantage includes a staggered configuration of the brushes that allows for the entire 360 degree periphery of the casing to be cleaned with the upper set of brush pads or upper scrapers pads. Another advantage is that the staggered configuration of lower scraper pads or lower brush pads that allows for the entire 360 degree periphery to be cleaned. Still yet another feature is that the device may be used in highly deviated and/or horizontal wells.

An advantage of the present invention is that the helical pad allows for channeling of well bore fluid in the annulus area. Another advantage is that the helical brushes and scraper pads (also referred to as ribs) allow for better cleaning of inner diameter of casing string. Yet another advantage is the scraper pads, and brushes are interchangeable with each other.

A feature of the present invention includes a novel locking mechanism brace that allows the clamping of a bundle of wire bristles. Another feature is that the novel locking mechanism includes triangular grooves formed within the pad that cooperate with a triangular brace profile fitted therein. Yet another feature is the dove tail locking means for selectively locking the pad onto the mandrel.

Another feature includes a spring loaded pad that urges the wire brush against the wall of the casing at a constant pressure. Thus, in a highly deviated well, both the high side and low side of the well will be cleaned. Still yet another feature is use of a centralizer that allows for the wire brush to be centered within well. This feature keeps both brushes centralized which in turn keeps the same pressure about the circumference of the casing walls.

Still yet another feature of the present invention includes use of helical brushes inserted into a helical pad. Another feature is the helical ribs that act to clean and centralizer the tool in a well bore. Yet another feature is that in one embodiment an upper row of helical brushes is used and lower row of helical ribs (also referred to as scraper pads) is used.

DETAILED DESCRIPTION OF THE PREFERRED EMBODIMENTS

Figure 1:
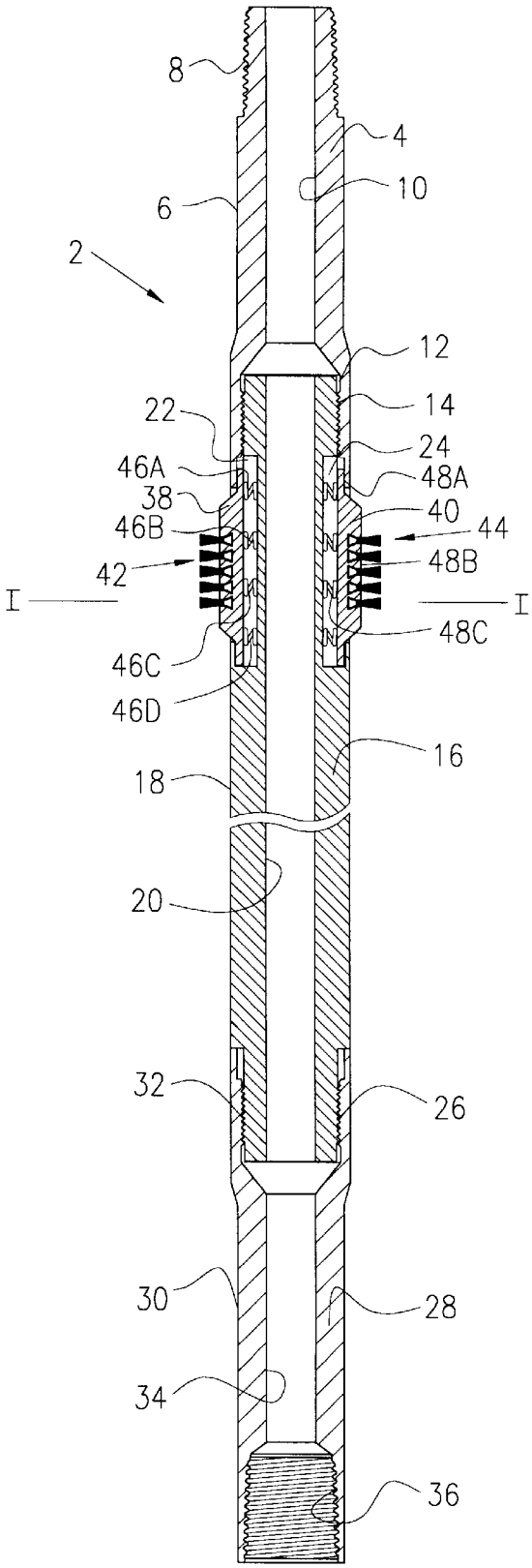
FIG. 1 is a cross-sectional view of the down hole cleaning assembly shown in a first phase.

Referring now to FIG. 1, a cross-sectional view of the down hole cleaning assembly 2 shown in a first phase will now be described. Generally, the assembly 2 includes a first mandrel 4 that has an outer diameter surface 6 that includes an external thread profile 8. The external thread profile 8 may be attached to a work string (not shown) such as drill pipe. It should be understood that other types of work strings are available such as snubbing pipe, coiled tubing, production strings, etc. The first FIG. 6.

Figure 9:
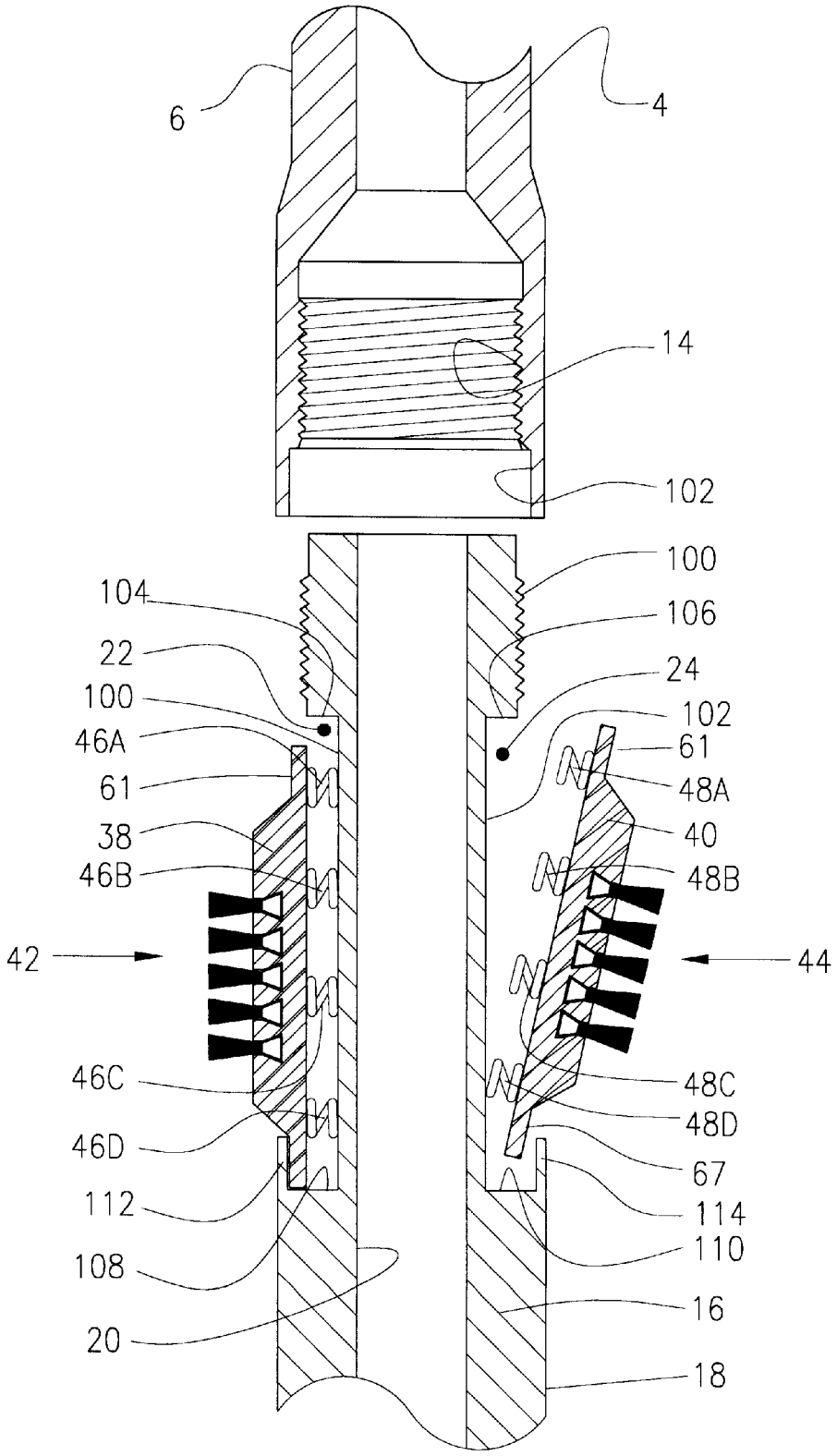
FIG. 9 is a cross-sectional view of an embodiment of the present invention that depicts dove tail means for attaching the pads to the down hole cleaning assembly.

FIG. 9 is a cross-sectional view of an embodiment of the present invention that depicts dove tail means for attaching the pads to the down hole cleaning assembly.

Figure 10:
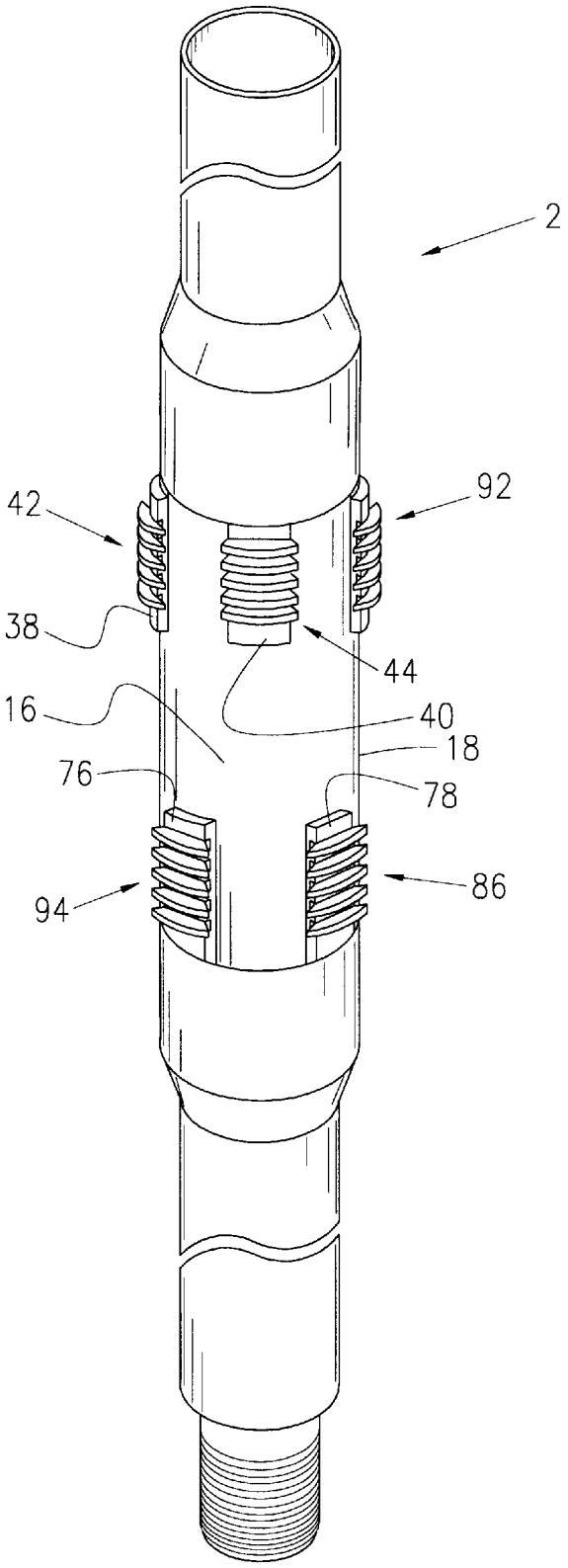
FIG. 10 is a perspective view of the down hole cleaning assembly of the preferred embodiment of the present invention.

FIG. 10 is a perspective view of the down hole cleaning assembly of the preferred embodiment of the present invention.

Figure 11:
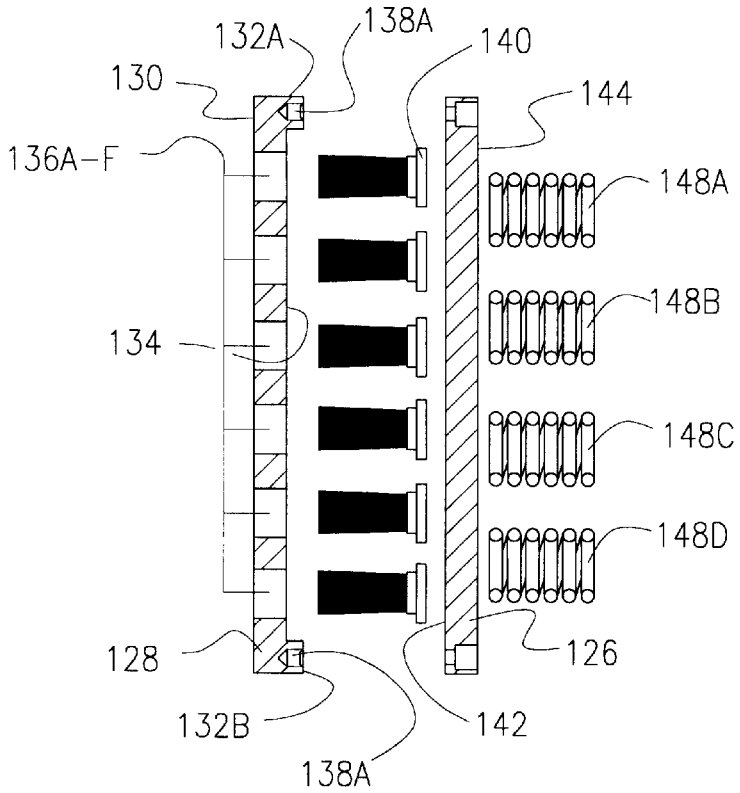
FIG. 11 is a disassembled cross-sectional view of a second embodiment of the pad and wire brush member.

FIG. 11 is a disassembled cross-sectional view of a second embodiment of the pad and wire brush member.

Figure 12:
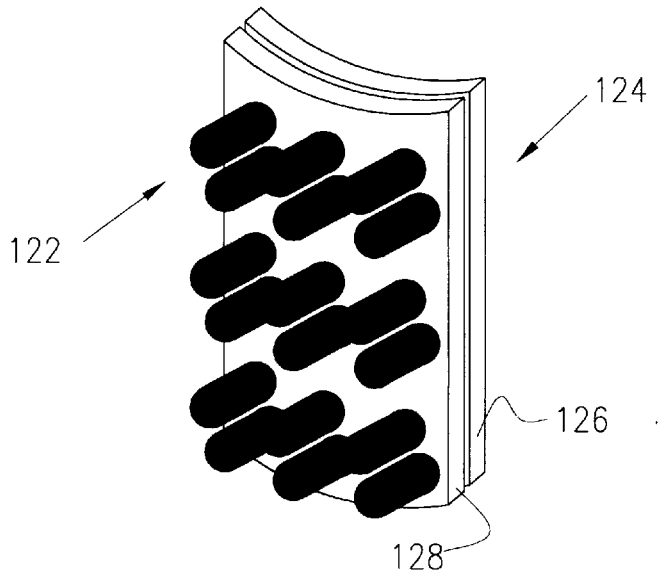
FIG. 12 is a perspective view of the pad and wire brush member of FIG. 11.

FIG. 12 is a perspective view of the pad and wire brush member of FIG. 11.

Figure 13:
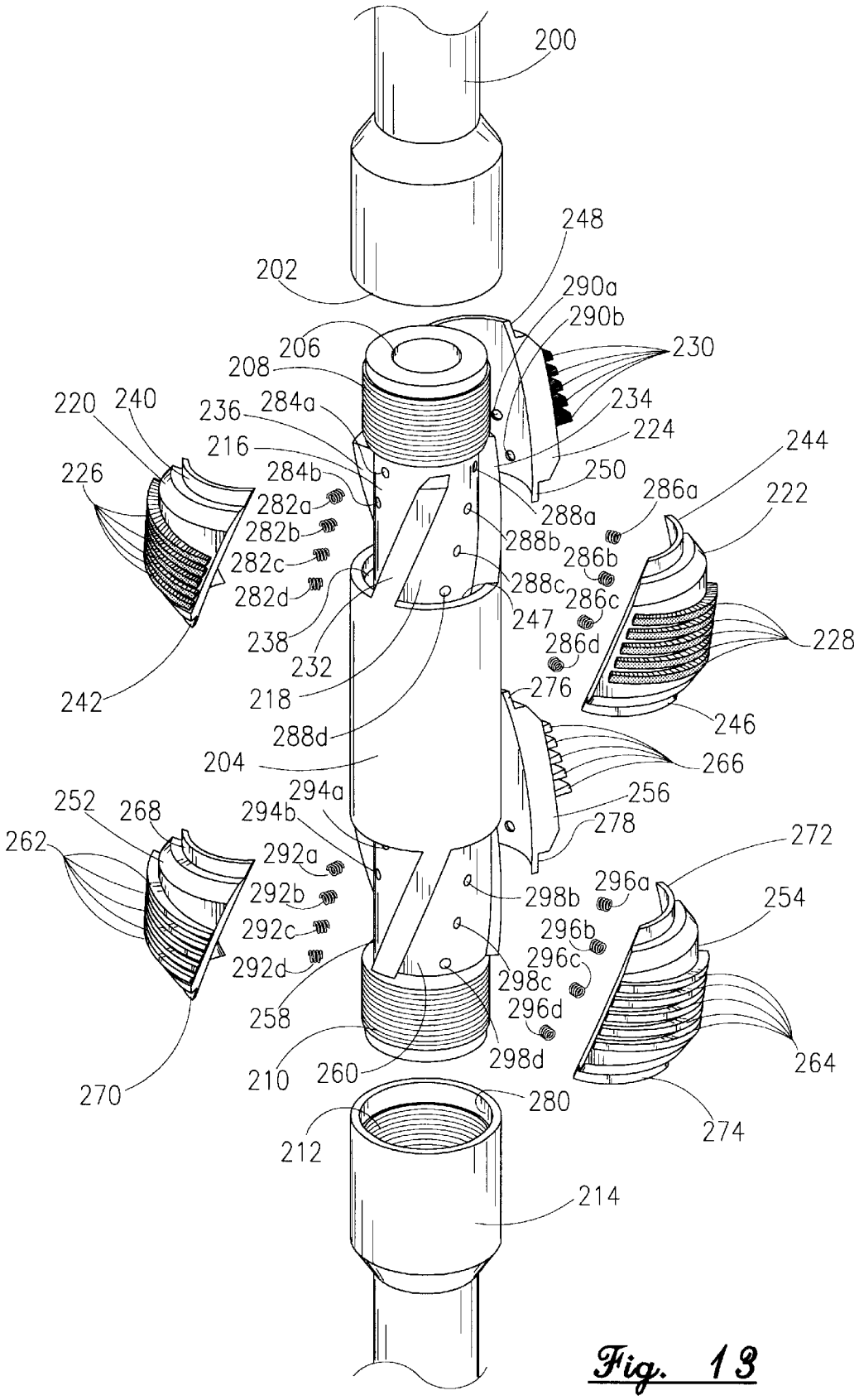
FIG. 13 is an oblique assembly view of the most preferred embodiment of this application.

FIG. 13 is a perspective, disassembled view of the preferred embodiment of the cleaning apparatus.

Figure 14:
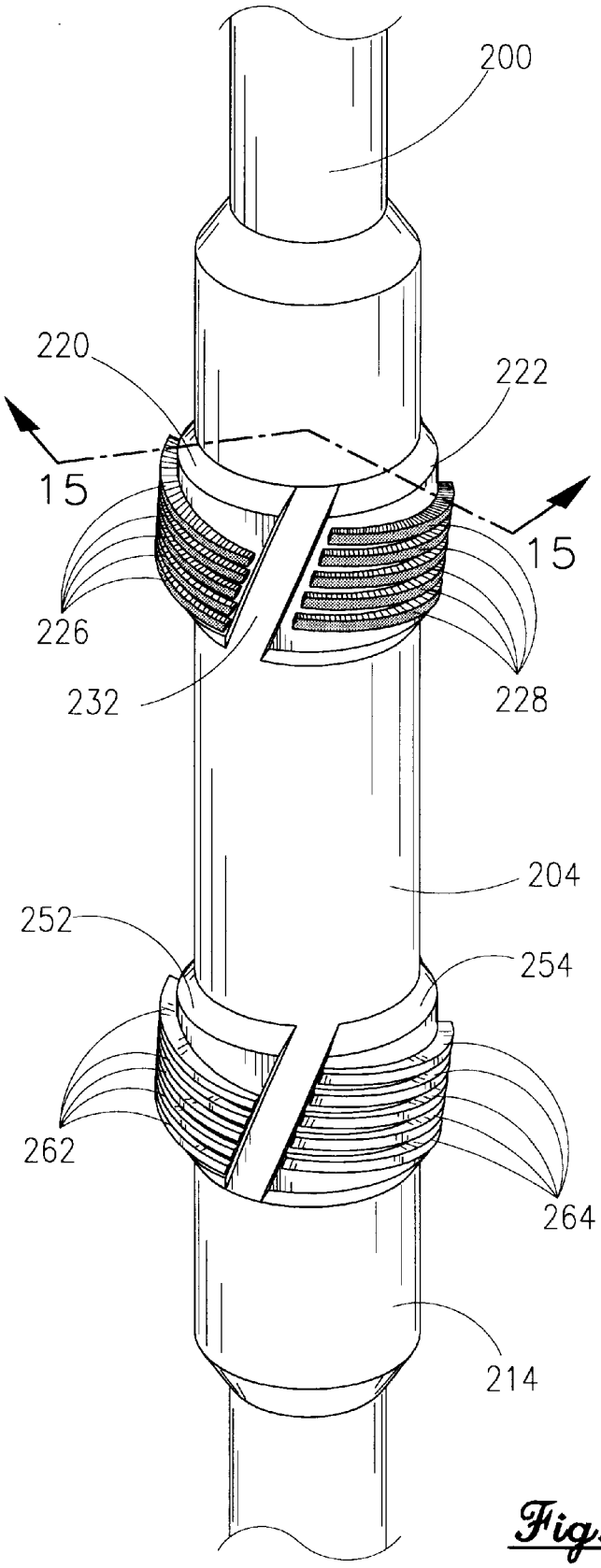
FIG. 14 is the assembled view of the most preferred embodiment of FIG. 13.

FIG. 14 is a perspective view of the assembled cleaning apparatus shown in FIG. 13.

DETAILED DESCRIPTION OF THE PREFERRED EMBODIMENTS

Referring now to FIG. 1, a cross-sectional view of the down hole cleaning assembly 2 shown in a first phase will now be described. Generally, the assembly 2 includes a first mandrel 4 that has an outer diameter surface 6 that includes an external thread profile 8 The external thread profile 8 may be attached to a work string (not shown) such as drill pipe. It should be understood that other types of work strings are available such as snubbing pipe, coiled tubing, production strings, etc. The first mandrel 4 will have a first internal bore 10 that extends to the second internal bore 12 that will have contained thereon internal thread means 14.

The assembly 2 contains a second mandrel 16 having an outer diameter 18 and an inner bore 20. The outer diameter 18 will have a series of openings formed therein, with FIG. 1 showing opening 22 and opening 24. It should be noted that in the preferred embodiment, there will be two rows of openings, with the first row along line A—A of FIG. 1 and the second row along line B—B of FIG. 6. Each row will contain three openings.

The outer diameter 18 may contain other openings that will be described later in the application. The outer diameter 18 will also contain the external thread means 26. In the embodiment shown in FIG. 1, the second mandrel 16 is made up to a third mandrel 28 The third mandrel 28 will have an outer diameter 30 that in turn extends radially inward to the internal threads 32 which in turn extends to the inner bore 34 that in turn leads to the internal threads 36. The third mandrel 28 may be attached to another down hole tool such as a bit.

The assembly 2 will have included the pad members 38, 40 that are operatively positioned within the openings 22, 24 respectively. The pad members 38, 40 will have a plurality of grooves formed therein with the grooves containing wire brush means 42, 44 for cleaning the internal diameter of a casing string. The wire brush means 42, 44 is generally a wire bristle arrangement that is commercially available from Spiral Brush, Inc. under the name steel wire. The bristles are manufactured from carbon or stainless steel.

The pad members 38 are operatively associated with biasing means 46, 48 for urging the pads 38, 40 (and in turn the wire brush means 42, 44) outwardly with respect to the casing. In the preferred embodiment, each opening will have four springs, including, a first spring 46A/48A, second spring 46B/48B, and the third spring 46C/48C. The spring loaded pads will allow for constant pressure of the brushes against the casing wall at all times. It should be noted that additional springs may be employed, for instance, when the device used has a large diameter so that more force is needed to adequately bias the pads.

The invention may have a plurality of openings within the outer diameter 18 for placement of additional pad and wire brush means as previously set out. With a staggered configuration of pads about the body of the mandrel 16, a 360 degree circumference about the inner diameter of the casing may be cleaned. This will be further explanation in reference to FIG. 6.

Figure 2:
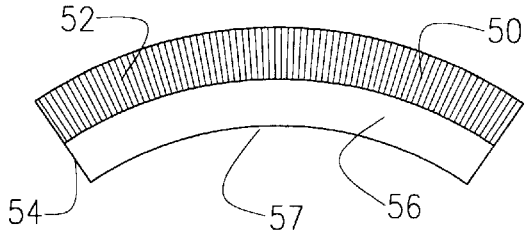
FIG. 2 is a top view of the wire brush member of the preferred embodiment of the present invention.

Referring now to FIG. 2, a top view of the wire brush member 42, 44 of the present invention will now be described in greater detail. The wire brush member 42, 44 includes a bundle of wires that can be purchased from Spiral Brush. The bundle of wires may be comprised of a carbon or stainless steel material. As depicted in FIG. 2, the bundle of wires 50 will have a first end 52 and a second end 54. The linear bundle of wires 50 is wrapped about a center rod 55. The second end 54 will be encapsulated within a brace 56, with the brace 56 tightly clamping about the second end 54 and rod 55 so that the wires are held together. Further, the brace 56 is arcuate with respect to radial surface 57 and has generally the same radius of curvature as that of the mandrel 16.

Figure 3A:
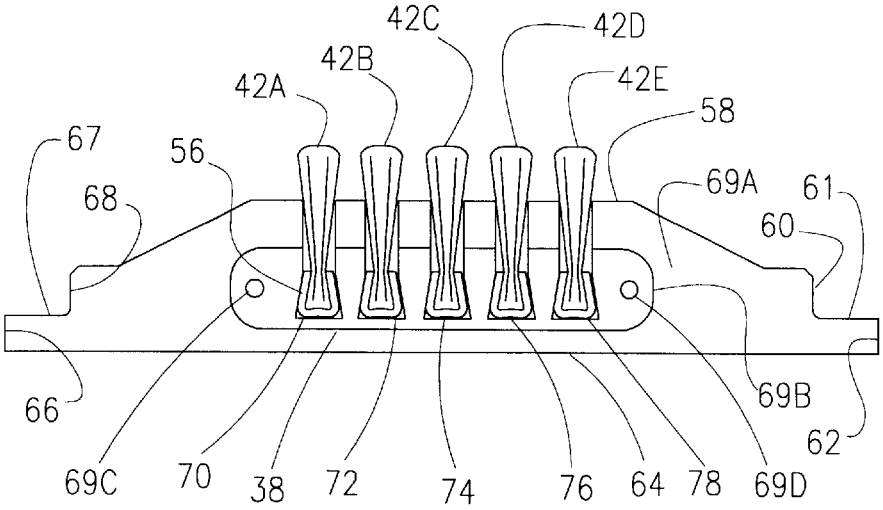
FIG. 3A is an end view of the pad member with wire brush member inserted therein of the preferred embodiment.

In reference to FIG. 3A, an end view of the pad member 38 with wire brush means 42 inserted therein is shown. In the preferred embodiment, the pad member 38 contains an outer surface 58 that slopes to first shoulder 60 that in turn extends to a surface 61 and then to a second shoulder 62. The second shoulder 62 advances to the internal surface 64 that in turn extends to a third shoulder 66 and surface 67 which in turn stretches to the fourth shoulder 68. The outer surface 58 will contain a series of grooves 70, 72, 74, 76, 78 that are formed in the pad 38 so that series of triangular profiles are formed therein. Thus, the braces 56 may be laterally placed therein.

Figure 3B:
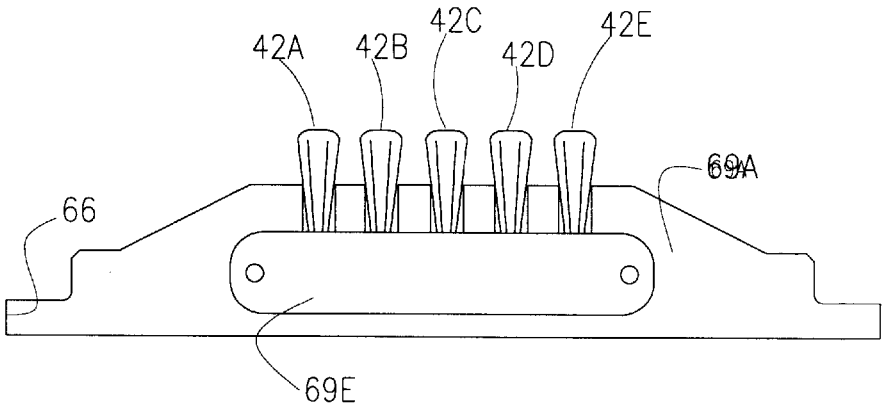
FIG. 3B is an illustration of FIG. 3A with the end plate inserted thereon.

Also, the present invention teaches having a groove 69B formed within the end face 69A. The end face 69A will have two openings 69C & 69D that will receive an attachment means such as a set screw. In FIG. 3B, the illustration of FIG. 3A is depicted with an end plate 69E operatively associated therewith. Thus, the end plate 69E will be inserted within the groove 69B, and will further have a pair of set screws that are inserted into the openings 69C & 69D. With the end plate in place, the wire brush means 42 are effectively locked into position so that they can not inadvertently back-out during operation. An end plate may be placed on all of the pad members.

Figure 4:
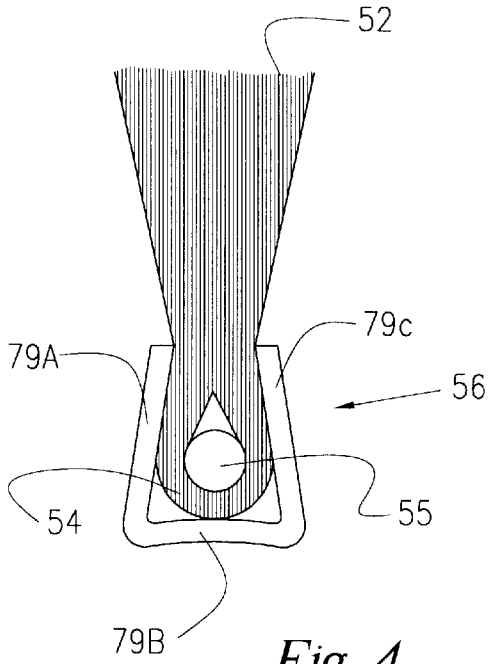
FIG. 4 is a side view detail of the wire brush member clamped with the brace member of the preferred embodiment.

With reference to FIG. 4, a side view detail of the wire brush means 42, 44 clamped with the brace member 56 of the present invention will now be described. The brace 56 may comprise a first leg 79A, a second leg 79B, and a third leg 79C, with the legs 79A, 79C bent in relation to each other so that a triangular profile is formed as well as clamping the second end 54 of the wire bundle. As stated earlier, the wire bundle will generally have a first end 52 that will serve to clean the casing. As shown, the clamping effect of the brace 56 causes the wire end 52 to expand which enhances the effectiveness of the wire scraping the casing wall as well as serving to clutch the wire bundle and rod 55 in place.

Figure 5:
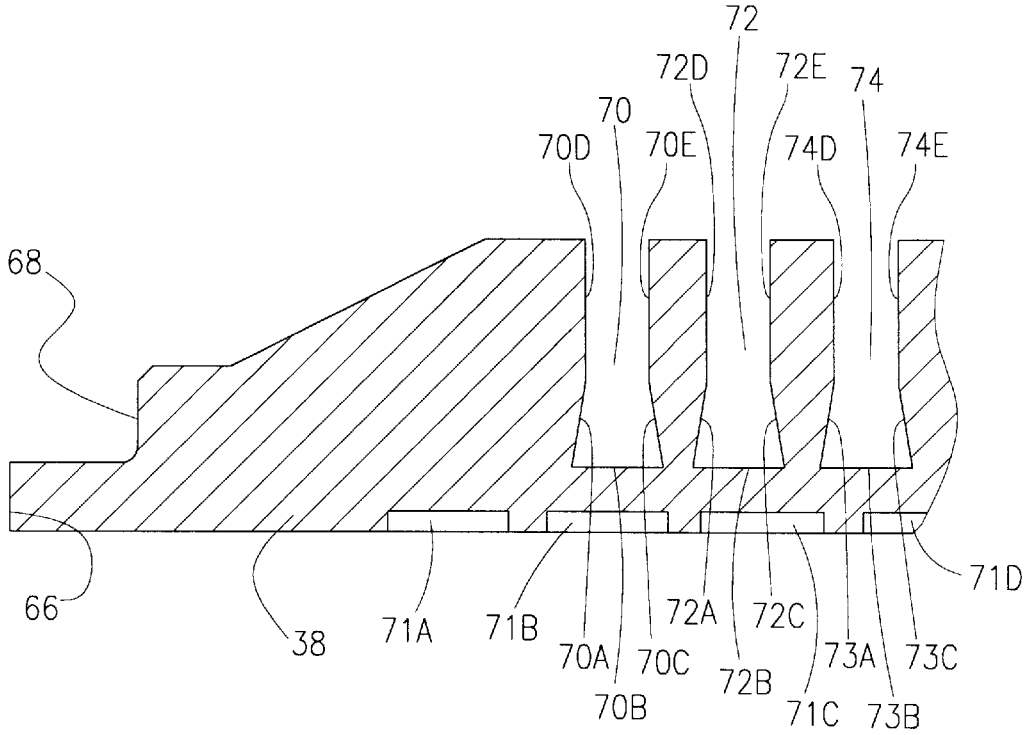
FIG. 5 is a side view detail of the pad member of FIG. 3.

In reference to FIG. 5, a side view detail of the pad member 38 of FIG. 3 is shown. It should be noted that like numbers appearing in the various figures correspond to like components. Thus, the pad member 38 will have a series of grooves 70–78. The individual grooves will have a first wall 70A, a second wall 70B, and a third wall 70C, with the three walls forming a triangular profile that is essentially patterned after the brace 56 so that the brace 56 may be slidably disposed therein. The triangular shaped profile allows for lateral placement of the brace 56 therein while at the same time securing the brace 56 from radial release from the grooves 70–78. The grooves 70–78 may also contain radial surfaces 70D, 70E, 72D, 72E, 74D and 74E.

FIG. 5 also depicts the channels 71A–D that may be included which receive and cooperate with the springs. Although not shown, the series of rows may be arranged in an inclined orientation relative to the axial bore which gives the series of rows a spiral effect. The inclined orientation allows for the displacement of the particles and compounds that are on the wall of the casing to be more easily channeled as the device is either being lowered into the well, raised from the well, or being rotated in the well.

The embodiment of FIG. 5 may also include an end plate member that contains two openings for placement of set screws to affix the plate member onto the pad. The plate member will hold the brushes in place and prevent the brushes from sliding out of the grooves.

Figure 6:
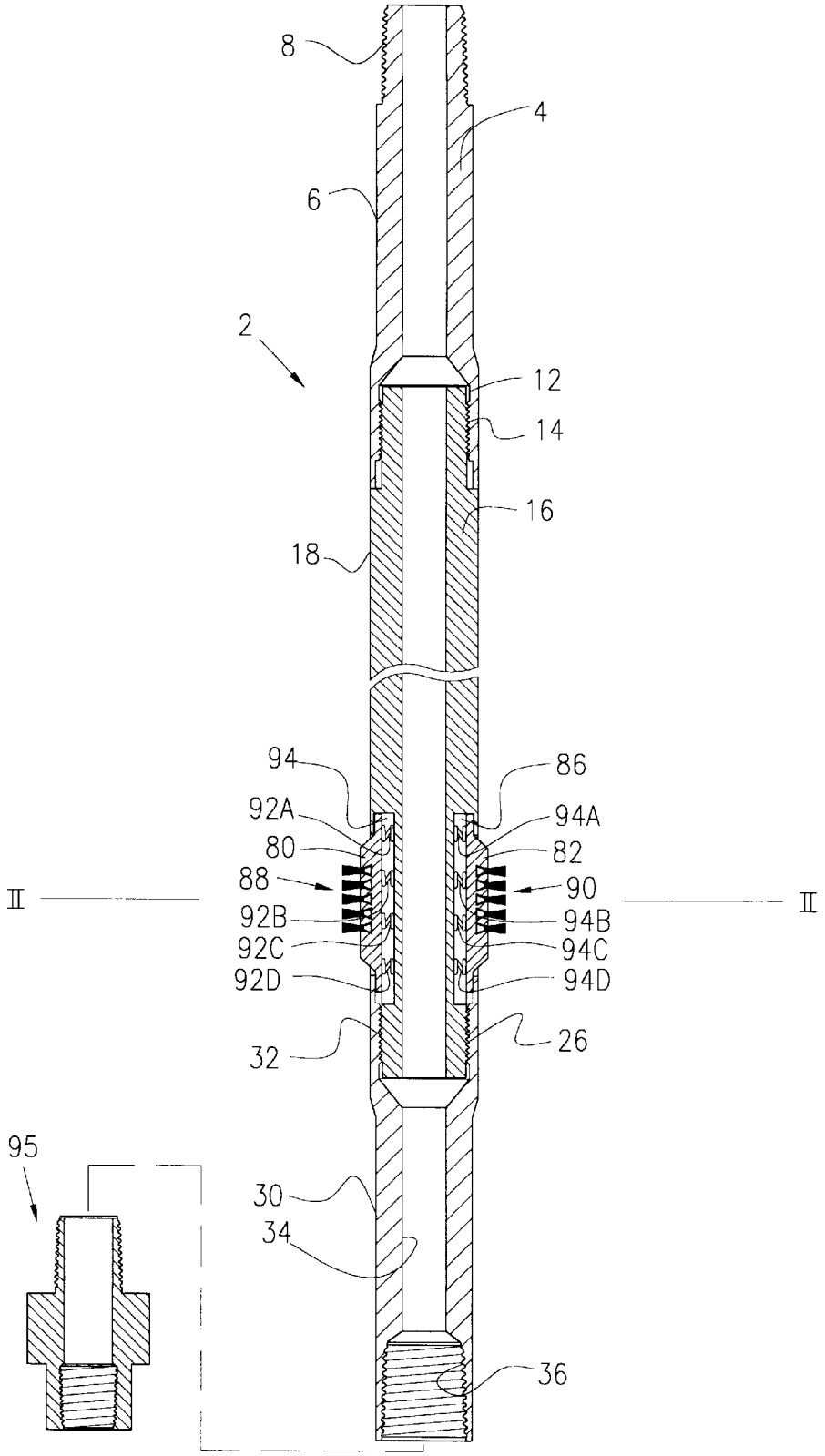
FIG. 6 is a cross-sectional view of the down hole cleaning assembly shown rotated to a second phase.

Referring now to FIG. 6, a cross-sectional view of the down hole cleaning assembly 2 shown rotated to a second phase will now be described. Thus, the drawing shows the second row including the pad member 80 and pad member 82 that will be inserted within the openings 84, 86. The pad members 76, 78 will have associated therewith the wire brush means 88 and 90, respectively for cleaning the internal diameter of the casing string. As set out earlier, the wire brush means 84, 86 will include the wire bundles clamped via a brace.

The pad member 76 will be urged outward toward the casing inner wall via the springs 92A, 92B, 92C and the pad member 78 will be urged outward toward the casing inner wall via springs 94A, 94B, 94C. As previously set forth, the springs 92A–C and 94A–C will urge the wire brush against the wall of the casing at a constant force. Thus, if the work string is being lowered through dog legs, or other highly deviated portions of the well, the springs will allow the retraction or urging as is necessary.

Figure 7:
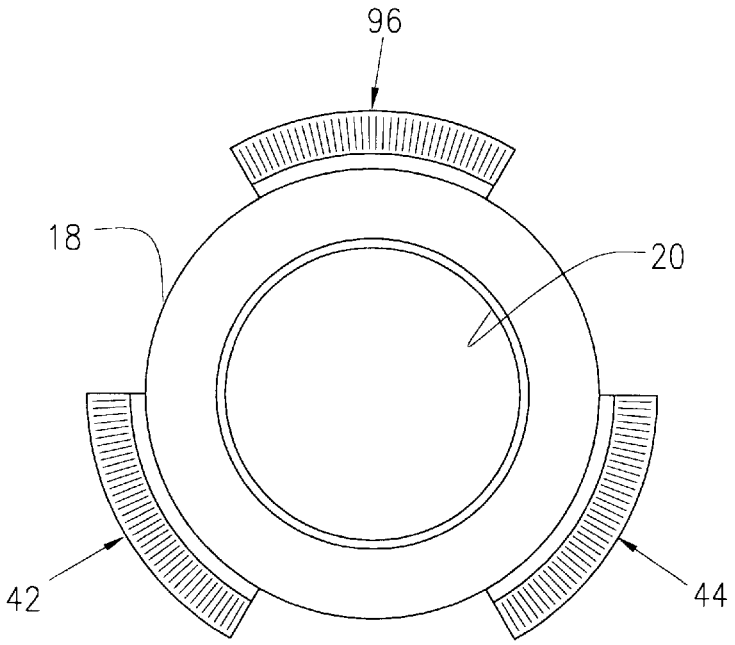
FIG. 7 is a cross-sectional view of line A—A taken from FIG. 1.

The illustration of FIG. 7 depicts a cross-sectional view of line A—A taken from FIG. 1. Thus, the brush means 42 and 44 are shown along with the brush means 96 in the first row. It should be noted that while three brush means 92 are shown in FIG. 7, the actual number may vary depending on numerous variables such as hole size, work string etc. The brush means 92 will be included within an opening along the pad and spring as previously described. The three brush means will provide for an effective radial cleaning phase area of 360 degrees.

Figure 8:
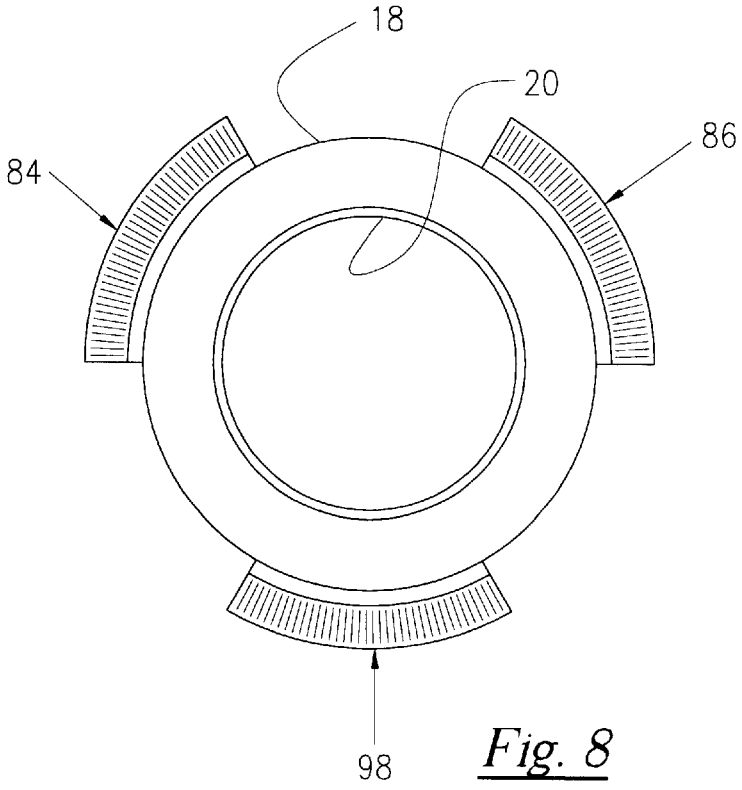
FIG. 8 is a cross-sectional view of line B—B taken from FIG. 6.

In FIG. 8, the drawing illustrates a cross-sectional view of line B—B taken from FIG. 6 wherein FIG. 6 depicts three brush means, namely 84, 86 and 98 in a second row. The construction of the pads, openings, springs and brush means is similar to those described in FIGS. 1 through 7. The three brush means will provide for an effective radial cleaning phase area of 360 degrees. As seen in FIG. 8, the individual brush means 84, 86, 94 are disposed in a different longitudinal phase when compared to the brush means 42, 44, 92 so that a staggered 360 degree coverage of the inner diameter may be accomplished during an operational trip into the casing string i.e. the entire inner diameter circumference will be cleaned.

FIG. 9 is a cross-sectional view of an embodiment of the present invention that depicts dove tail means for attaching the pads to the down hole cleaning assembly 2. More particularly, the first mandrel 4 will have the internal threads 14 that cooperate with the external threads 100 of the second mandrel 16. The internal threads 14 lead to a inner bore surface 102.

The external threads 96 extend to the openings 22, 24 that have radial shoulders 104, 106. The openings 22, 24 are generally slots that are formed on the periphery of the mandrel 16 and are adapted to receive the pads 38, 40 as previously described. The slots formed will terminate at the shoulders 108, 110 that in turn extends to the lip 112, 114. The lips 108, 10 then lead to the outer diameter surface 18. It should be noted that while two openings 22, 24 are shown in FIG. 9, the preferred embodiment will contain three staggered openings about the periphery as shown in FIG. 7.

Therefore, when the tool is to be assembled, the operator may place the springs 46A–46C and 48A–46C within the openings 22, 24. The pads 38, 40 are then placed within the openings 22, 24. The surface 67 of the pad member 40 is placed within the opening 24 such that the surface 67 and lip 110 abut each other and with the pads 38, 40 up against the shoulder 104 and 106. Next, the first mandrel 4 is threadedly connected with the second mandrel 16 by making up threads 14 with threads 96. The inner bore surface 97 will slide-over the lip 61. With the lip 61 in place, the inner bore surface 97 will hold the pads 38, 40 so that the pads may be biased radially outwardly via springs 46A–46C and 48A–48C. Meanwhile, the surface 67 will engage the lip 108, 110 so that the pad members 38, 40 are held in position.

Thus, the individual pad members may be replaced on location by threadedly removing the mandrel 4, withdrawing the old pad member, and thereafter placing a new pad member with new brush means thereon into the openings. Next, the operator could then threadedly make up the mandrel 4 onto mandrel 16 as previously set forth.

Also, the mandrel 28 will have similar thread means with an inner bore surface for making up to the mandrel 16 so that the second series of pad members 76, 78 may be similarly dove tailed for selectively adapting said pad members 76, 78 with the mandrels 16, 28.

The invention is illustrated in a perspective view in FIG. 10. Thus, in the preferred embodiment, the brush means 42, 44, 92 are positioned in a first row while the brush means 84, 86, 94 are positioned in a second row. Also, the FIG. 10 depicts the pads 38, 40, 76, 78 disposed within openings contained on the mandrel 16 as previously described.

There is yet another embodiment possible with the teachings of the present invention. Referring now to FIG. 11, the embodiment includes a different type of wire brush means 122 operatively associated with the pad member 124. The pad member 124 includes the first plate 126 and the second plate 128 which allows for the back side placement of the brush means 122 through the second plate 128.

The pad member 124 of FIG. 11 will be received within the openings 22, 24, 84, 86 etc. previously mentioned. The plates 126, 128 are arcuate so that they fit into the contour of the outer diameter of the mandrel 16. The second plate 128 will have an outer surface 130 that extends to the ledges 132A–B which in turn extends to the inner surface 134. The second plate 128 has disposed therein the openings 136A–F and the ledge 132 has openings 138A–B.

Also depicted in FIG. 11 is the wire brush means 122 for cleaning the internal diameter of said casing string as previously described. The wire brush means 122 is also commercially available from Spiral Brush Inc. In this embodiment, the individual wire brush means 122 are disposed through the openings 126A–F and are generally circular arranged about a base 140. The base 140 is of a diameter greater than the diameter of the opening 136 so that the wire brush means 122 can not pass therethrough.

The first plate 126 contains the first surface 142 that stretches to a second surface 144. The second surface 144 will have disposed therein openings 146A, 146B. A fastener, such as a screw, may be placed therethrough and be operatively attached with the second plate 128 via the openings 138A, 138B. In this manner, the wire brush means 122 will fit through the openings and once the plates 126 and 128 are fastened together, the wire brush means 122 are locked into position.

The spring means 148A–D will be positioned so that one end of the spring is up against the surface 144 while the other end is against the surface 102, for instance. Thus, the spring means 148A–148D will bias the pad member 124 axially outward into engagement with the wall of the casing string as previously set forth. FIG. 12 is a perspective view of the pad 124 and wire brush member 122 of FIG. 11 assembled.

Referring now to FIG. 13, the preferred embodiment of this application will now be described. A first tubular member 200 is provided, with the tubular member 200 being concentrically disposed within a casing string. The tubular 200 is generally part of a work string such as a drill string, production string, coiled tubing, snubbing, etc. The tubular 200 has an open end 202 that contains internal thread means (not shown in this figure).

FIG. 13 also depicts the mandrel 204, with the mandrel 204 having a generally cylindrical outer surface and an internal bore section 206. The mandrel 204 has a first end that contains external thread means 208 that will mate and cooperate with the internal thread means of the tubular 200. The mandrel has a second end that contains the external thread means 210 that will threadedly attach to the internal thread means 212 of the second tubular member 214. The second tubular member 214 may be further connected to other tubular members. The open end 202 will have an annular ring, also referred to as an inner bore surface 102 shown in FIG. 9. The open end of second tubular member 214 also contains this inner bore surface (also referred to as an annular ring 280 in FIG. 13).

The mandrel 204 will contain a plurality of helical openings, for instance helical opening 216 and helical opening 218. A third helical opening is provided but not shown in the FIG. 13. The helical openings will have disposed therein the helical pads 220, 222, 224. The helical pads contain an arcuate body with parallelogram sides. The pads 220, 222, 224 will contain slotted grooves for placement of the row of brushes as was previously explained as well as seen in FIGS. 2, 3, 4, 5, 6. The pad 220 will contain the brush means 226 the pad 222 will contain the brush means 228 and the third pad 224 will contain the brush means 230. The brush means 226, 228, 230 are also constructed as previously set out and as seen in FIGS. 2, 3, 4, 5, 6.

The openings 216, 218, 220 will leave formed on the mandrel body the arms 232, 234, 236 thereby forming the slotted area the helical pads 220, 222, 224 are fitted into. The opening 216 also contains the partial radial annular groove 238, the opening 218 contains a partial radial groove 247, and the opening 220 contains a partial radial groove (not shown in this figure). The helical pad 220 contains the lip section 240 that will cooperate with the annular groove on the tubular 200. The helical pad 220 also has the lip section 242 that will cooperate with the partial radial annular groove 238. The helical pad 222 contains the lip section 244 that will cooperate with the annular groove on the tubular 200. The helical pad 222 also has the lip section 246 that will cooperate with the partial radial annular groove 247. The helical pad 224 contains the lip section 248 that will cooperate with the annular ring on the tubular 200. The helical pad 220 also has the lip section 250 that will cooperate with the partial radial annular groove on the mandrel 204. The lip sections cooperate with the openings and the annular ring of the tubular member 200 in order to form means for selectively attaching the pads to the mandrel 204, which is also referred to as dove tail means, operatively associated with the mandrel, for selectively attaching the helical pad members to the mandrel.

FIG. 13 also depicts a plurality of centralizer means which include helical pads 252, 254, 256. The pads 252, 254, 256 are inserted into the three helical openings 258, 260 (the third opening is not shown in this figure). The pads centralize as well as scrape and clean the inner diameter. The pads 252, 254, 256 have a series of annular ribs arranged in a slanted fashion 262, 264, 266, respectively. Each of the pads 252, 254, 256 have a lip section, namely lip section 268, 270 for pad 252; lip section 272, 274 for pad 254; lip section 276, 278 for pad 256. A partial radial annular groove is provided within each window. Thus, lip section 268 will fit into a partial radial groove, lip section 272 will fit into a partial radial groove, and lip section 276 will fit into a partial radial annular groove.

The tubular member 214 will have an annular ring 280 (also referred to as an inner bore surface) in its open end. Thus, the lip section 270 will cooperate with annular ring 280, lip section 274 will cooperate with annular radial groove 280, and lip section 278 will cooperate with annular radial groove 280 when the thread means 212 is threadedly engaged with thread means 210 so that pads 252, 254, 256 are held in the three openings (258, 260). These pads 252, 254, 256 are to clean as well as centralize the mandrel 204. Other stabilizer means may be added to the work string if desired. For instance, a stabilizer may be added above or below the mandrel 204. An example is shown in FIG. 6.

Also included is means for biasing the pads radially outward. When the apparatus is concentrically disposed within a well bore, the biasing means will bias the pads radially outward against the casing walls at a constant force, regardless if the well bore is highly deviated or horizontal. Thus, FIG. 13 depicts the conical springs 282*a*, 282*b*, 282*c*, 282*d* that will have one end inserted into an aperture milled into the mandrel 204, such as the apertures 284*a*,284*b*. In the preferred embodiment, each spring will be associated with a hole; in FIG. 13, the apertures for 282*c* and 282*d* are not shown due to the curvature of the mandrel 204.

The springs 286*a*, 286*b*, 286*c*, 286*d* will have the apertures 288*a*,288*b*,288*c*,288*d*, respectively, for biasing the pad 222 outward. The placement of the springs is along a helical path, as shown, which is also parallel to the arms e.g. 232. The helical pads of this embodiment will have a corresponding aperture for placement of the second end of the various springs. FIG. 13 depicts this feature as apertures 290*a*, 290*b*. With reference to the lower helical pads of the embodiment depicted in FIG. 13, the springs 292*a*, 292*b*, 292*c*, 292*d* are associated with apertures within the mandrel body 204 as previously stated. The apertures 294*a*, 294*b* are shown. Further, there is included the springs 296*a*, 296*b*, 296*c*, 296*d* operatively associated with the apertures within the mandrel body 204; those depicted in FIG. 13 include apertures 298*d*, 298*b*, 298*c*. It should also be noted that an aperture 300*a* within helical pad 256 is also depicted.

FIG. 14 depicts the assembled view of the most preferred embodiment of FIG. 13. Thus, the pad 220 is seen with the brush means 226 and pad 222 is seen with brush means 228. The pad 252 is seen with the annular rib pattern 262 and the pad 254 is seen with the annular rib pattern 264. Note that the rib pattern is slanted in a first direction and the brush means is slanted in the same direction. However, the rib pattern may be slanted in a first direction and the brush means may be slanted in an opposite direction. Further, with the unique design herein disclosed, all of the scraper pads and brush pads are interchangeable with each other. The operator can then have all brush pads; or all scraper pads; or a combination of brush pads and scraper pads. In other words, top row can have just brush pads, or just scraper pads, or a combination of the two. The bottom row can have just brush pads, or just scraper pads, or a combination of the two.

The line 227 in FIG. 14 depicts the fact that with this novel design, the top brushes means 226*a* and the bottom brush means 228*a* effectively overlap so that a 360 degree phase coverage or more is produced by this spiral design. Without the spiral design, it was not possible in the prior art to have the top brush (located on a first pad) and the bottom brush (located on a second pad) to cover a 360 degree phase. In other words, with the prior art designs of longitudinal straight pads, a gap in coverage existed and effectively required a lower set of completely independent brush means and/or scraper pads to fill-in this gap. This design solves this problem.

Figure 15:
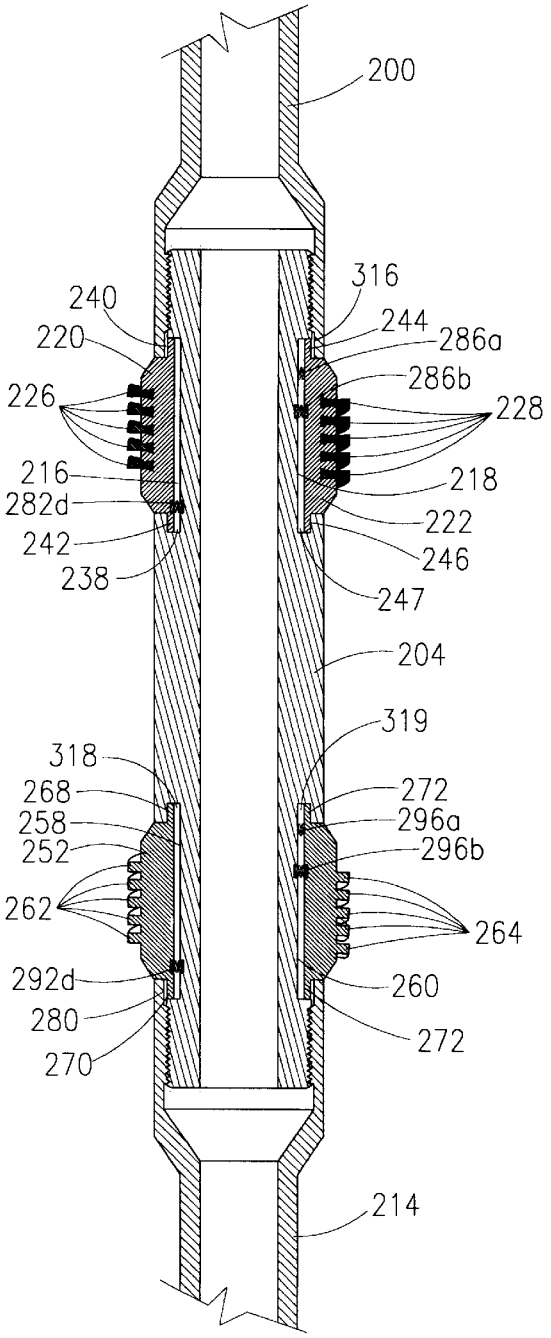
FIG. 15 is a cross-sectional view of the most preferred embodiment of FIG. 13.

Referring now to FIG. 15, a cross-sectional view of the preferred embodiment of this invention is illustrated. FIG. 15 is similar to FIGS. 1 and 6 in that they depict the dove tail means for selectively attaching the pads to the mandrel. More particularly, the lip 240, 244 is surrounded by the annular ring surface 316 contained on the tubular 200. Further, FIG. 15 depicts the annular radial groove 238 with lips 242, 246 positioned therein. Also included is the annular radial groove 318, 319 that has contained therein the lips 268, 272. The annular ring 280 is configured to selectively attach the lips 270, 272.

Figure 16:
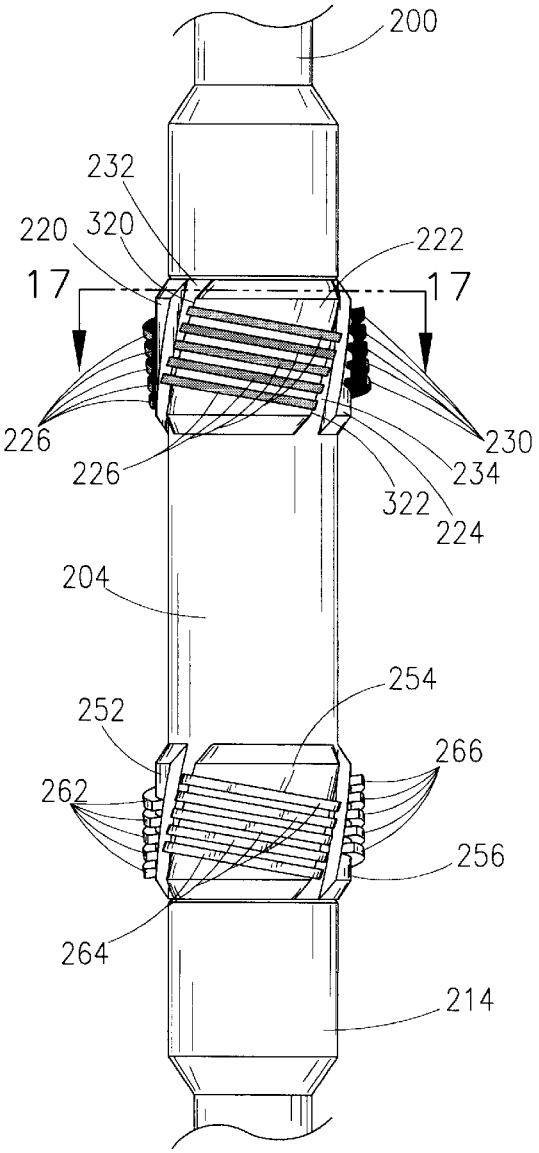
FIG. 16 is a front view of the most preferred embodiment of FIG. 13.

FIG. 16 illustrates a front view of the apparatus and in particular the helical pads. The front view of the helical pad 222 depicts generally a parallelogram having the side 320 that is slanted and parallel with the side 322, as well as parallel top and bottom sides. Note that the angle of the slant can be varied. In the most preferred embodiment, there is a 360 degree of peripheral coverage when cleaning a casing string. In other words, the brushes will effectively cover the entire 360 degree phase of the inner diameter. The lower pads with the annular ribs 264, 262, 266 may be slanted in the same direction and can also be designed to cover an effective 360 degree phase. It should be noted that it is also possible to have the slant of the upper brushes in an opposite slope than the lower annular ribs. As shown, there is a plurality of rows of brushes/ribs. The fluid being circulated within the annulus of the well bore can, therefore, be directed through the individual helically arranged brushes/ribs rows as well as channeled along the arms 232, 234, 236 during operation. Also, rotation of the work string is enhanced by the helically arranged brushes.

Figure 17:
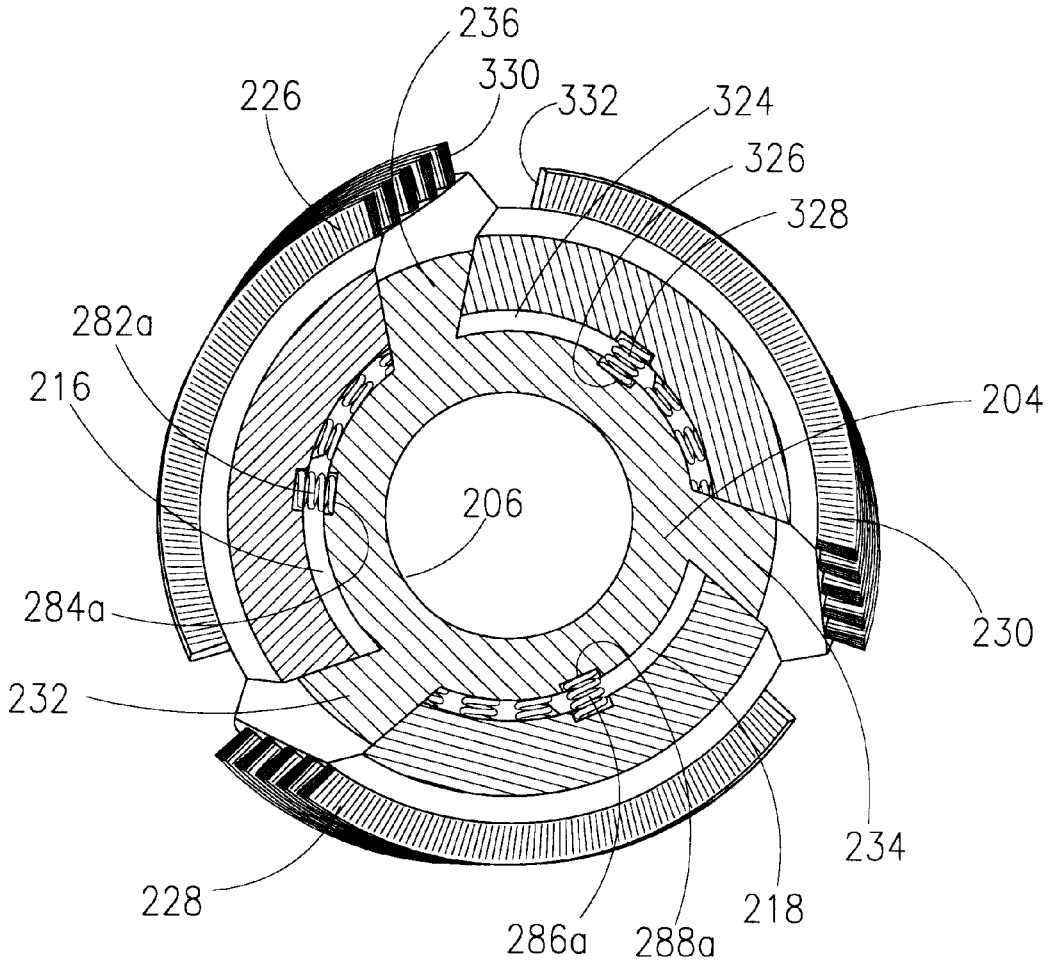
FIG. 17 is a cross-sectional view of the most preferred embodiment of FIG. 13 taken along line 17 of FIG. 16.

Referring now to FIG. 17, a cross sectional view of the apparatus taken along line 17 of FIG. 16 will now be described. The mandrel 204 with the internal bore 206 is shown, with the openings 216, 218, 324 is illustrated. The apertures 284*b*, 288*b*, 326 are shown with the springs 282*a*, 286*a*,328 mounted therein, respectively. The brushes 226, 228,230 are shown. The side arms of the openings are also depicted at 232, 234, 236. It should be noted that the brushes are inserted into a groove within the respective pads as previously described. The brush end 330 concludes so that there is a channel or gap between a complementary brush end 332. The channel, along the arms 232, 234, 236 provides a passage for fluid, debris and solids to channel through the tool.

It should be noted that in the preferred embodiment of FIGS. 13, 14, 15, 16, and 17, that the lower helical pads are comprised of a series of annular extending ribs. Thus, the helical pads 252, 254, 256 are constructed similar to that seen in FIG. 17, except that annular extending ribs are used rather than the brush means. The annular extending ribs will be formed on the pad such as by milling as is well understood by those of ordinary skill in the art. The types of metals that the pads and ribs may be constructed of include metal, aluminum, plastic, etc.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

I claim:

1. A down hole assembly for attachment to a first tubular member and a second tubular member within a well bore, the first tubular member having an opened end with a first annular ring formed thereon, and the second tubular member having an opened end with a second annular ring formed thereon, and wherein the down hole assembly comprises:

a mandrel having a first end and a second end, said first end of said mandrel being configured to be connected to the opened end of the first tubular member and said second end of said mandrel being configured to be connected to the opened end of the second tubular member, and wherein said mandrel contains a first helical opening;

a first helical pad configured to be positioned within said first helical opening, said helical pad having a groove therein;

a first lip extending from said first helical pad, said first lip being configured to adapt to said first annular ring in order to attach said first helical pad to the first tubular member;

a first wire brush member inserted within said groove;

a first spring inserted between said first helical pad and said mandrel, said spring biasing said helical pad radially outward.

2. The down hole assembly of claim 1 wherein said mandrel further comprises a second helical opening and the down hole assembly further comprises:

a second helical pad configured to be positioned within said second helical opening, said second helical pad having a second groove therein;

a second wire brush member inserted within said second groove;

a second lip extending from said second helical pad, said second lip being configured to adapt to said first annular ring in order to attach said first helical pad to the first tubular member;

a second spring inserted between said second helical pad and said mandrel, said second spring biasing said second helical pad radially outward.

3. The down hole assembly of claim 2 wherein said mandrel contains a third helical opening and the second tubular member contains a second annular ring, and wherein the down hole assembly further comprises:

a third helical pad configured to be positioned within said third helical opening, said third helical pad having a series of annular ribs;

a third lip extending from said third helical pad, said third lip being configured to adapt to said second annular ring in order to attach said first helical pad to the first tubular member;

a third spring inserted between said third helical pad and said mandrel, said third spring biasing said third helical pad radially outward.

4. The down hole assembly of claim 3 wherein said mandrel further comprises a fourth helical opening and the down hole assembly further comprises:

a fourth helical pad configured to be positioned within said fourth helical opening, said fourth helical pad having a series of annular ribs;

a fourth lip extending from said third helical pad, said fourth lip being configured to adapt to said second annular ring in order to attach said fourth helical pad to the second tubular member;

a fourth spring inserted between said fourth helical pad and said mandrel, said fourth spring biasing said fourth helical pad radially outward.

5. The down hole assembly of claim 4 wherein said first wire brush member comprises:

a wire bundle having a first end and a second end;

a brace disposed about said second end of said wire bundle;

and wherein said brace is disposed within said first groove of said pad member.

6. The down hole assembly of claim 5 wherein said brace comprises:

an open end and a closed end, with the closed end having disposed therein said second end of said wire bundle, and wherein said open end and said closed end cooperate to form a triangular shaped profile.

7. The down hole assembly of claim 6 wherein said first groove has an angular shaped profile adapted to slidably receive said triangular shaped profile of said brace.

8. The down hole assembly of claim 7 wherein said first wire brush member and said second wire brush member are arcuate, and wherein said first wire brush member is disposed about the periphery of said mandrel to cover a first phase and wherein said second wire brush member is disposed about the periphery of said mandrel to cover a complimentary second phase.

9. A method of cleaning a casing string, said casing string having an internal portion, the method comprising:

lowering a work string within said internal portion of said casing string;

providing a cleaning apparatus attached to said work string, said apparatus comprising: a first tubular member and a second tubular member within the casing string, the first tubular member having an opened end with an annular ring formed thereon, and the second tubular member having an opened end with an annular ring formed thereon; a mandrel having a first end and a second end, said first end of said mandrel being configured to be connected to the opened end of the first tubular member and said second end of said mandrel being configured to be connected to the opened end of the second tubular member, and wherein said mandrel contains a first and second helical opening; a first and second helical pad configured to be positioned within said first and second helical opening, said first and second helical pad having a groove therein; a lip extending from said first and second helical pad, said lip being configured to adapt to said annular ring; a wire brush member inserted within said groove; a first and second spring inserted between said first and second helical pad and said mandrel, said first and second spring biasing said first and second helical pad radially outward;

urging said wire brush member against the internal portion of said casing string with said first and second spring;

cleaning the internal portion of said casing string.

10. The method of claim 9 further comprising:

rotating the work string;

lowering the work string;

circulating a fluid through the internal portion of the work string and returning the fluid in an annulus area;

channeling the fluid through the first and second helical pad.

11. The method of claim 10 wherein said well casing has a highly deviated section so that a low side of the well casing and a high side is created, and the apparatus further comprises a centralizer operatively associated with said work string, with the first helical pad covering a first phase and the second helical pad covering a second phase, and wherein the method further comprises:

lifting the apparatus from the low side of the well casing with said centralizer;

urging said wire brush member of the first helical pad against the low side of the well casing with said first spring at a constant force;

urging said wire brush member of the second helical pad against the high side of the inner diameter of the well casing with said second spring at the constant force.

12. An apparatus for cleaning an inner diameter of a casing string, the apparatus comprising:

a mandrel having a first end and a second end, said first end of said mandrel being configured to be connected to an opened end of a first tubular member and said second end of said mandrel being configured to be connected to an opened end of a second tubular member, and wherein said mandrel contains a first helical opening;

a first helical pad configured to be positioned within said first helical opening, said first helical pad having a first groove therein;

a first wire brush member inserted within said first groove;

a first spring inserted between said first helical pad and said mandrel, said spring biasing said helical pad radially outward;

dove tail means, operatively associated with said mandrel, for selectively attaching said first and second helical pad member with said mandrel.

13. The apparatus of claim 12 wherein said dove tail means comprises the first tubular member having an opened end with an annular ring formed thereon that engages a first lip extending from said first helical pad, said first lip being configured to adapt to said annular ring so that said first helical pad is held in place by said annular ring.

14. The apparatus of claim 13 further comprising:

a second helical opening formed on said mandrel;

a second helical pad configured to be positioned within said second helical opening, said second helical pad having a second groove therein and wherein said second helical pad includes a second lip extending therefrom;

a second wire brush member inserted within said second groove;

a second spring inserted between said second helical pad and said mandrel, said second spring biasing said second helical pad radially outward;

and wherein the dove tail means further comprises: the second tubular member having an opened end with an annular ring formed thereon that engages said second lip so that said second helical pad is held in place by said annular ring.

15. The apparatus of claim 14 further comprising:

a third helical opening formed on said mandrel;

a third helical pad configured to be positioned within said third helical opening, said third helical pad having a series of annular ribs;

a third spring inserted between said first helical pad and said mandrel, said third spring biasing said third helical pad radially outward.

16. The apparatus of claim 15 further comprising:

a fourth helical opening formed on said mandrel;

a fourth helical pad configured to be positioned within said fourth helical opening, said fourth helical pad having a series of annular ribs;

a fourth spring inserted between said second helical pad and said mandrel, said fourth spring biasing said fourth helical pad radially outward.

17. The apparatus of claim 16 wherein said first wire brush member comprises:

a wire bundle having a first end and a second end;

a brace disposed about said second end of said wire bundle;

and wherein said brace is disposed within said first groove of said first helical pad member.

18. The apparatus of claim 17 wherein said brace comprises:

an open end and a closed end, with the closed end having disposed therein said second end of said wire bundle, and wherein said open end and said closed end cooperate to form a triangular shaped profile.

19. The apparatus of claim 18 wherein said first groove has an angular shaped profile adapted to slidably receive said wedge of said brace.

20. The apparatus of claim 19 wherein said first wire brush member and said second wire brush member are arcuate, and wherein said first wire brush member is disposed about the periphery of said mandrel to cover a first phase and wherein said second wire brush member is disposed about the periphery of said mandrel to cover a second phase so that a top end of said first wire brush member overlaps a bottom end of said second wire brush member.

* * * * *